US012655982B1

(12) United States Patent
Liu

(10) Patent No.: US 12,655,982 B1
(45) Date of Patent: Jun. 16, 2026

(54) RETRACTABLE AND FOLDABLE WOOD-BURNING STOVE

(71) Applicant: Wuyi Focean Import and Export Co., Ltd., Jinhua (CN)

(72) Inventor: Fuyun Liu, Jinhua (CN)

( * ) Notice: Subject to any disclaimer, the term of this patent is extended or adjusted under 35 U.S.C. 154(b) by 0 days.

(21) Appl. No.: 19/434,006

(22) Filed: Dec. 29, 2025

(30) Foreign Application Priority Data

Nov. 3, 2025 (CN) ..... 202522330244.2

(51) Int. Cl.

| | |
|---|---|
| ***F24B 1/18*** | (2006.01) |
| ***F24B 1/181*** | (2006.01) |
| ***F24B 5/02*** | (2006.01) |
| ***F24C 1/16*** | (2021.01) |

(52) U.S. Cl.
CPC ..... *F24B 1/18* (2013.01); *F24B 1/181* (2013.01); *F24B 5/026* (2013.01); *F24C 1/16* (2013.01)

(58) Field of Classification Search
CPC .. F24B 1/18; F24B 1/181; F24B 5/026; F24C 1/16
See application file for complete search history.

(56) References Cited

U.S. PATENT DOCUMENTS

| | | | | |
|---|---|---|---|---|
| 11,846,428 | B1 * | 12/2023 | Cantelar | F24B 3/00 |
| 11,879,641 | B2 * | 1/2024 | Weilert | F24B 5/021 |
| 12,000,593 | B1 * | 6/2024 | Cantelar | F24C 1/16 |
| 12,127,707 | B1 * | 10/2024 | Cantelar | A47J 37/0658 |
| 2020/0146505 | A1 * | 5/2020 | Bell | A47J 37/0623 |

* cited by examiner

*Primary Examiner* — Alfred Basichas

(57) ABSTRACT

The present invention discloses a retractable and foldable wood-burning stove, comprising a furnace liner, a base, and a telescoping structure. The furnace liner has a first annular wall member and a liner seat attached to the member's lower part; the liner seat and first annular wall member form a combustion chamber with a fuel tray inside. The base comprises a second annular wall member and a bottom plate connected to the member's lower part; the bottom plate and second annular wall member define a storage cavity, second annular wall member sleeves first annular wall member. The telescoping structure links base and furnace liner, enabling the furnace liner to move relative to the base and adjust the liner seat's position storage cavity. Retracting the furnace liner and base reduces stove's overall volume collapsed state, enhancing outdoor portability and cutting storage space.

10 Claims, 3 Drawing Sheets

RETRACTABLE AND FOLDABLE WOOD-BURNING STOVE

TECHNICAL FIELD

The present invention relates to the field of outdoor supplies technology, and particularly to a retractable and foldable wood-burning stove.

BACKGROUND TECHNOLOGY

As an efficient thermal energy supply device, a wood-burning stove is widely used in outdoor camping, rural life, and emergency heating and cooking scenarios. Its core function is to convert thermal energy through fuel combustion to meet diverse heating needs. With the trend toward lightweight outdoor equipment, ease of portability and minimal space occupation have become key directions for technical upgrades. In the prior art, most stoves are primarily composed of a fixed pot rack, a smoke exhaust body, a furnace body, and an ash box. Among these components, the furnace body and the ash box are rigidly connected. The coaxial arrangement of the furnace core, secondary oxygen supply chamber, and tertiary oxygen supply chamber enables complete combustion of fuel; meanwhile, the stove recovers residual heat from flue gas via a smoke exhaust heating tube to achieve energy-saving effects. However, the said furnace body, pot rack, and smoke exhaust body of this type of wood-burning stove form an integral fixed structure. The overall volume is large and non-detachable, and its size cannot be adjusted according to the state of use or transport. Consequently, it occupies a large amount of space when carried and is inconvenient for outdoor use.

DISCLOSURE OF THE INVENTION

In view of the shortcomings in the prior art, the present utility model discloses a retractable and foldable wood-burning stove, comprising:

A furnace liner, which includes a first annular wall member and a liner seat connected to the lower part of the said first annular wall member, wherein the said liner seat and the first annular wall member collectively define a combustion chamber, and a fuel tray is disposed within the said combustion chamber;

A base, which includes a second annular wall member and a bottom plate connected to the lower part of the said second annular wall member, wherein the said bottom plate and the second annular wall member collectively define a storage cavity; and the said second annular wall member sleeves over the first annular wall member;

A telescoping structure, which is connected to the said base and the said furnace liner; wherein the said furnace liner is capable of moving relative to the base via the telescoping structure to change the position of the liner seat within the storage cavity.

Preferably, the said telescoping structure comprises a plurality of sliding assemblies, wherein the said sliding assembly includes a sliding groove member and a guiding member, and the said guiding member is connected to the sliding groove member and is capable of moving within the sliding groove of the corresponding sliding groove member;

The said sliding groove member is mounted inside the said base, and the said guiding member is mounted on the said furnace liner, wherein the said furnace liner is capable of moving up and down within the said storage cavity via the said guiding member along the sliding groove; or the said sliding groove member is mounted on the said furnace liner, and the said guiding member is mounted inside the said base, wherein the said furnace liner is capable of moving up and down within the said storage cavity via the guiding member along the sliding groove.

Preferably, the said sliding groove member is vertically mounted within the said storage cavity, and the said guiding member is mounted on the said first annular wall member, wherein the said first annular wall member is capable of moving up and down within the storage cavity along the sliding groove of the said sliding groove member.

Preferably, the said first annular wall member includes a first outer wall and a first inner wall constructed inside the first outer wall, wherein the bottom of the said first inner wall is connected to the liner seat, and the liner seat and the said first inner wall collectively define the combustion chamber;

A gas guiding space is enclosed between the said first outer wall and the first inner wall, and an air inlet communicating with the said gas guiding space is clamped and formed by the bottom of the first outer wall and the bottom of the first inner wall; the upper part of the said second annular wall member sleeves over the outer side of the said first outer wall.

Preferably, the said sliding groove member is a connecting plate, wherein a sliding groove is opened on the said connecting plate, one end of the said connecting plate is mounted on the said bottom plate, and the other end is connected to the first annular wall member via the guiding member; the said guiding member is capable of sliding up and down on the said connecting plate along the said sliding groove.

Preferably, a fixed clasp is opened inside the end of the said connecting plate away from the bottom plate, and a guiding channel is opened on the side of the said fixed clasp, wherein the said fixed clasp communicates with the end of the said sliding groove away from the bottom plate through the said guiding channel; the said guiding member is capable of entering the said fixed clasp from the sliding groove through the said guiding channel, or entering the sliding groove from the said fixed clasp through the said guiding channel.

Preferably, an upwardly protruding limiting portion is constructed at the lower wall of the said guiding channel, and the lower part of the said fixed clasp has a bearing surface for bearing the said guiding member, wherein the said limiting portion is connected to the said bearing surface.

Preferably, the said guiding member is a guiding column installed on the side opposite to the said first inner wall and the first outer wall and protruding towards the direction of the said first outer wall; or the said guiding member is a guiding column installed on the side opposite to the said first outer wall and the first inner wall and protruding towards the direction of the said first inner wall;

When the said guiding column moves along the sliding groove inside the sliding groove member, the said sliding groove member moves within the gas guiding space.

Preferably, a first sealing ring protruding outward is constructed circumferentially at the bottom of the said first outer wall, and a second sealing ring protruding inward is constructed circumferentially at the top of the said second annular wall member.

Preferably, the said base further includes a plurality of leg members connected to the lower part of the said bottom plate, wherein the said leg members are capable of rotating inward and folding relative to the said bottom plate, and the upper part of the said first annular wall member is connected to the upper part of the said first annular wall member through a heat concentrating ring member to close the upper part of the said gas guiding space.

The retractable and foldable wood-burning stove disclosed by the present utility model includes a furnace liner, a base, and a telescoping structure, wherein the furnace liner includes a first annular wall member and a liner seat connected to the lower part of the said first annular wall member, the said liner seat and the first annular wall member collectively define a combustion chamber, and a fuel tray is disposed within the said combustion chamber; the base includes a second annular wall member and a bottom plate connected to the lower part of the said second annular wall member, the said bottom plate and the second annular wall member collectively define a storage cavity; the said second annular wall member sleeves over the first annular wall member; the telescoping structure is connected to the said base and the furnace liner; the said furnace liner is capable of moving relative to the base via the telescoping structure to change the position of the liner seat within the storage cavity. Thus, when portability is required, the furnace liner and the base can be retracted, which significantly reduces the overall volume of the wood-burning stove in the collapsed state, facilitating outdoor carrying and minimizing storage space.

DESCRIPTION OF DRAWINGS

In order to more clearly illustrate the technical solution in the embodiments of the present application, a brief introduction to the drawings required for use in the description of the embodiments will be made below. Obviously, the drawings in the following description are only some embodiments of the present application, and for those skilled in the art, other drawings can be obtained according to these drawings without creative efforts.

In order to more fully understand the present application and its beneficial effects, the following description will be made in conjunction with the drawings. Among them, the same reference numerals in the following description represent the same parts.

Figure 1:
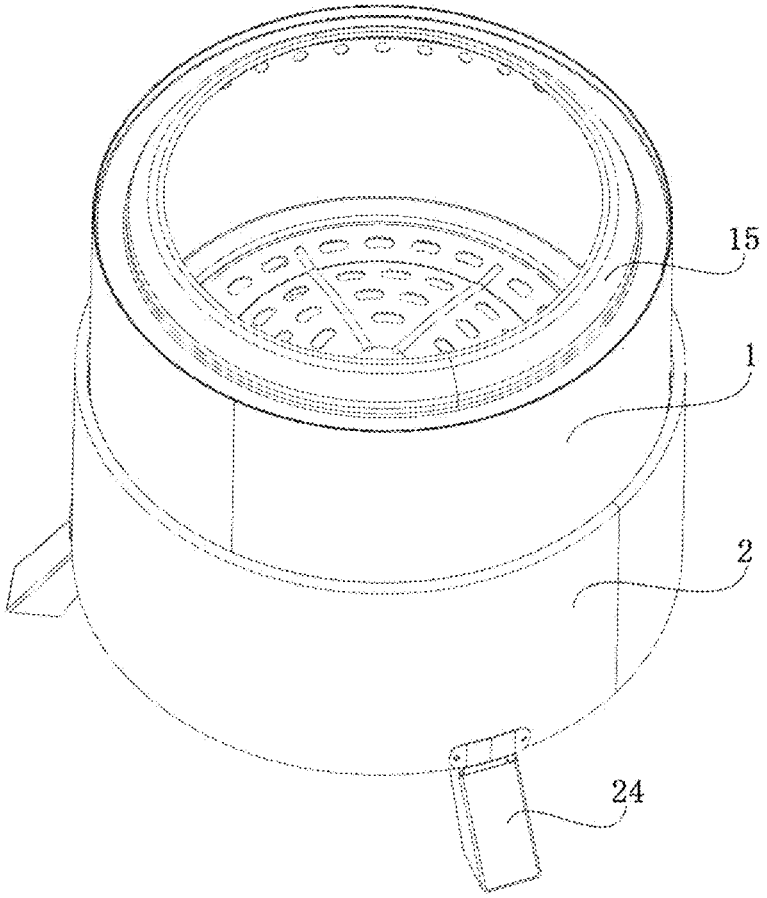
FIG. 1 is a schematic structural view of the wood-burning stove disclosed in an embodiment of the present application.
Figure 2:
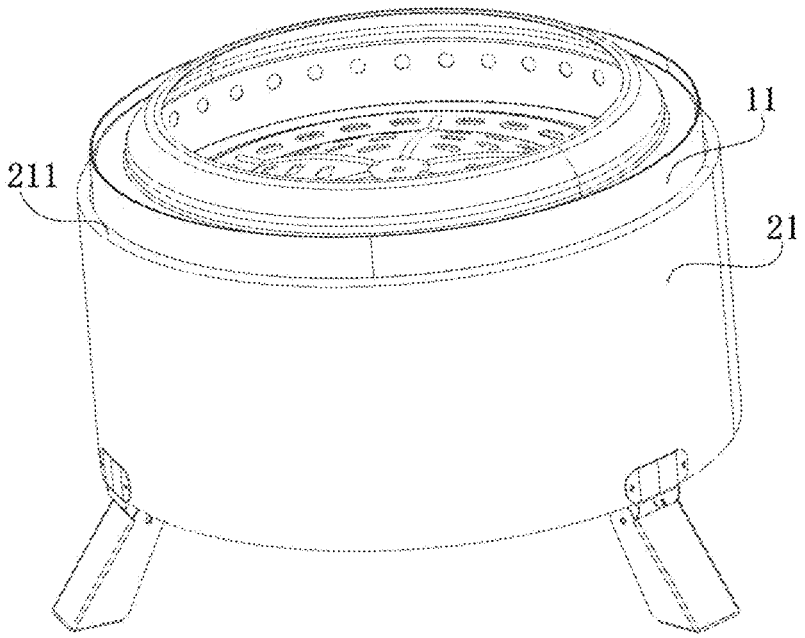
FIG. 2 is a schematic view of the folded and collapsed state of the wood-burning stove disclosed in an embodiment of the present application.
Figure 3:
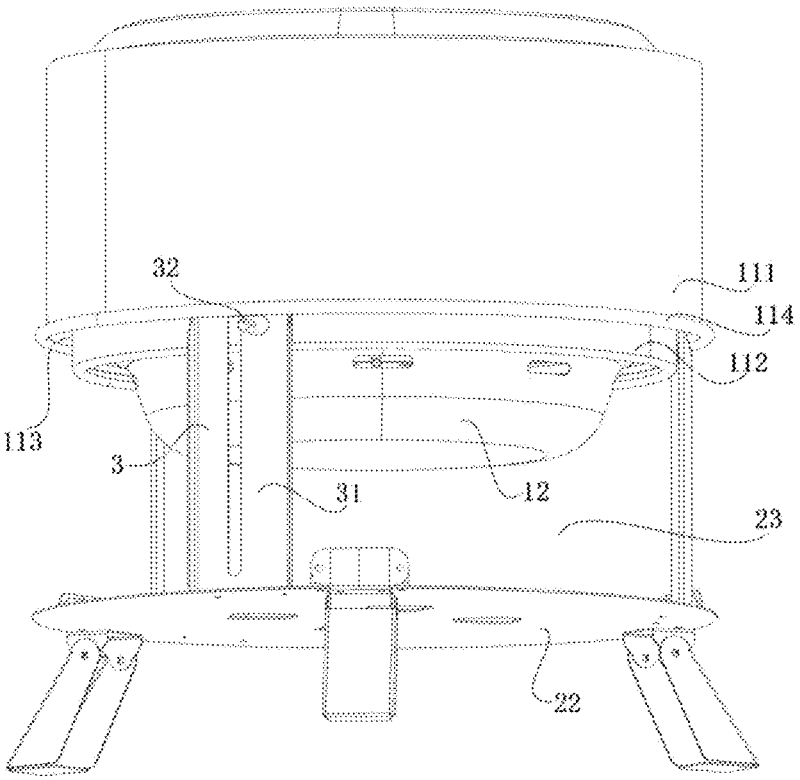
FIGS. 3-5 are schematic internal structural views of the wood-burning stove disclosed in an embodiment of the present application.
Figure 4:
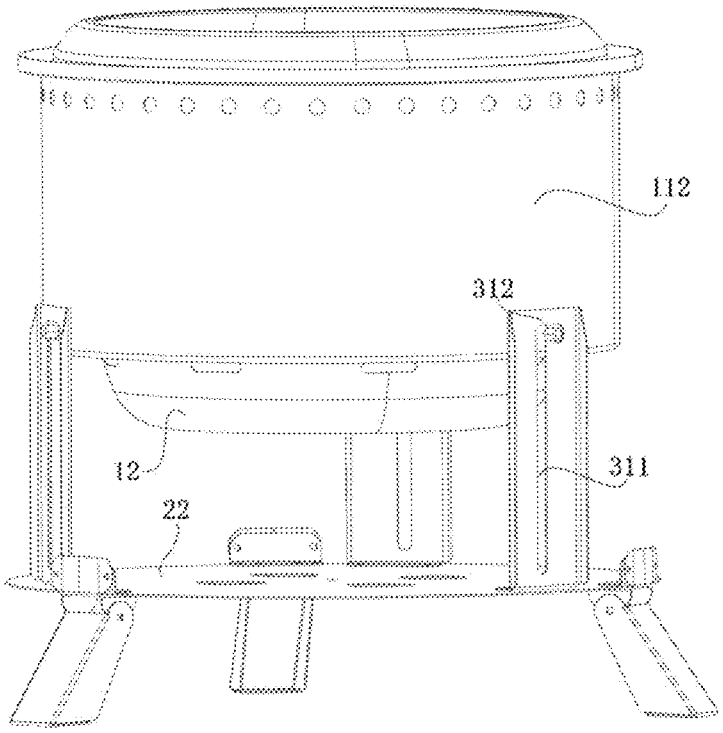
Figure 5:
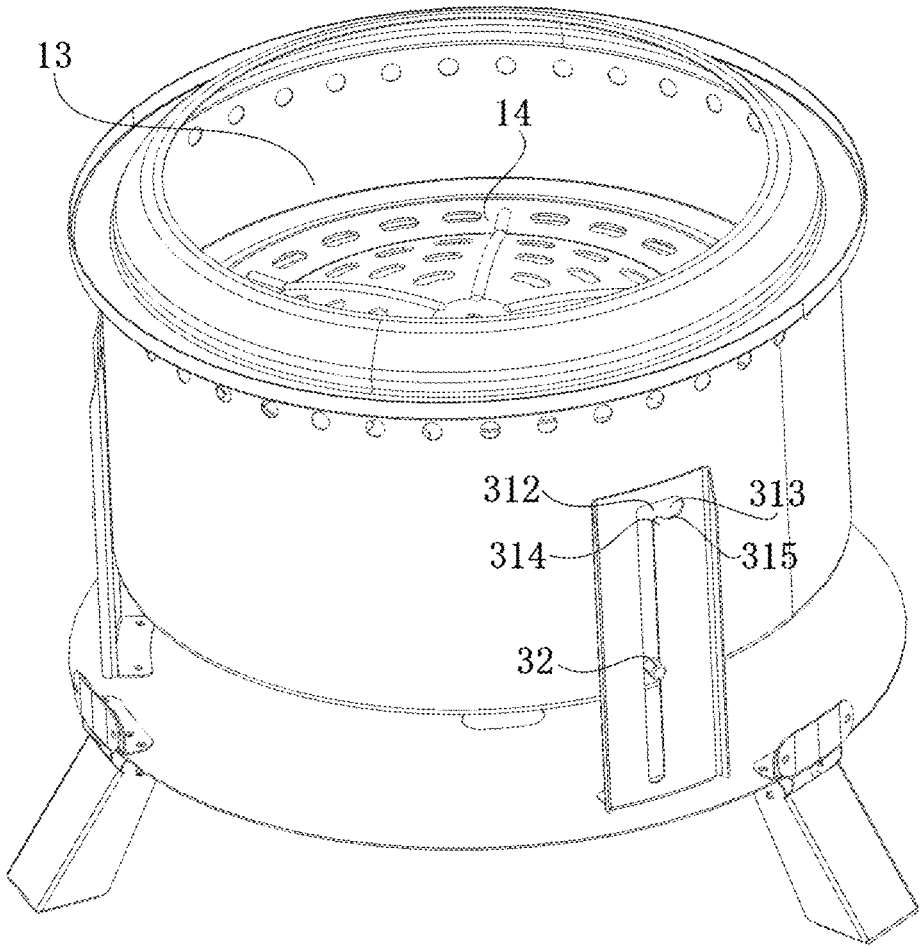

Reference signs in the drawings: 1, Furnace liner; 11, First annular wall member; 12, Liner seat; 13, Combustion chamber; 14, Fuel tray; 15, Heat concentrating ring member; 111, First outer wall; 112, First inner wall; 113, Gas guiding space; 114, First sealing ring; 2, Base; 21, Second annular wall member; 211, Second sealing ring; 22, Bottom plate; 23, Storage cavity; 24, Leg member; 3, Telescoping structure; 31, Sliding groove member; 32, Guiding member; 311, Sliding groove; 312, Fixed clasp; 313, Guiding channel; 314, Limiting portion; 315, Bearing surface.

DETAILED EMBODIMENTS

In order to make the objectives, technical solutions, and advantages of the embodiments of the present utility model clearer, the technical solutions of the embodiments of the present utility model will be clearly and completely described below in conjunction with the accompanying drawings of the embodiments of the present utility model. Obviously, the said described embodiments are only a part of the embodiments of the present utility model, and not all of the embodiments. Based on the said described embodiments of the said utility model, all other embodiments obtained by those skilled in the art without making creative efforts shall fall within the protection scope of the said utility model.

In the description of the said utility model, it should be understood that the orientation or positional relations indicated by the terms "upper," "lower," "front," "rear," "left," "right," "top," "bottom," "inner," "outer," and the like are based on the orientation or positional relations shown in the drawings, and are only for the convenience of describing the said utility model and simplifying the description, rather than indicating or implying that the said device or element must have a specific orientation, be constructed, and be operated in a specific orientation, and thus should not be understood as a limitation on the said utility model.

In the said utility model, unless otherwise clearly specified and limited, terms such as "mounted," "coupled," "connected," and "fixed" should be understood in a broad sense. For example, they may be a fixed connection, a detachable connection, or an integral connection; they may be a mechanical connection or an electrical connection; they may be directly connected or indirectly connected through an intermediate medium, and may be the internal communication between two components. For those of ordinary skill in the art, the said terms mentioned above can be understood in their specific meanings in the said utility model according to the specific circumstances.

Unless otherwise defined, the technical or scientific terms used herein shall have the ordinary meaning understood by those of ordinary skill in the art to which the said utility model belongs. The words "first," "second," and similar words used in the said specification and claims of the said utility model patent application do not denote any order, quantity, or importance, but are merely used to distinguish between different components. Similarly, words such as "a," "an," or "one" do not denote a limitation on quantity, but rather denote the presence of at least one.

The present embodiment discloses a retractable and foldable wood-burning stove, comprising: a furnace liner 1, a base 2, and a telescoping structure 3. Wherein the furnace liner 1 includes a first annular wall member 11 and a liner seat 12 connected to the said lower part of the said first annular wall member, the said liner seat 12 and the first annular wall member collectively define a combustion chamber 13, and a fuel tray 14 is disposed within the said combustion chamber; the base 2 includes a second annular wall member 21 and a bottom plate 22 connected to the said lower part of the said second annular wall member 21, the said bottom plate 22 and the second annular wall member 21 collectively define a storage cavity 23; the said second annular wall member 21 sleeves over the first annular wall member 11; the telescoping structure 3 is connected to the said base 22 and the furnace liner 1; the said furnace liner 1 is capable of moving relative to the base 22 via the telescoping structure 3 to change the position of the liner seat 12 within the storage cavity 23. Wherein, the fuel tray 14 can stably bear fuel such as firewood and charcoal, preventing the fuel from directly contacting the liner seat 12 which may cause local overheating damage, while ensuring that the fuel burns centrally within the combustion chamber 13 to reduce heat loss; the storage cavity 23 provides accommodation space for the retraction of the furnace liner 1. During operation, if the overall volume of the wood-burning stove needs to be reduced for carrying or storage, a downward external force is applied to the furnace liner 1 by operating the telescoping structure 3. The first annular wall member 11 will slide downward along the sleeving structure of the second annular wall member 21, driving the liner seat 12 to gradually enter the interior of the storage cavity 23 until the liner seat 12 is fitted against the bottom plate 22 or reaches the desired retracted position. At this point, the overall height of the wood-burning stove is lowered, and the volume is significantly reduced. If expansion for use is required, an upward external force is applied to the furnace liner 1 via the telescoping structure 3. The first annular wall member 11 slides upward along the second annular wall member 21, and the liner seat 12 gradually protrudes from the interior of the storage cavity 23, and the exposed space of the combustion chamber 13 increases accordingly until a preset position is reached. In some preferred embodiments, the second annular wall member 21 and the first annular wall member 11 adopt a sleeving structure, which ensures that the furnace liner 1 always maintains coaxiality when moving relative to the base 2, prevents offset and shaking, and guarantees stability during the telescoping process; the telescoping structure 3 acts as a connecting and transmission component, directly transmitting the external force and limiting the moving direction of the furnace liner 1, ensuring that it only moves along the vertical direction.

In the said embodiment, the said telescoping structure 3 comprises a plurality of sliding assemblies, the said sliding assembly includes a sliding groove member 31 and a guiding member 32, the said guiding member 32 is connected to the said sliding groove member 31 and is capable of moving within the sliding groove of the corresponding sliding groove member 31; the said sliding groove member 31 is mounted inside the said base 2, the said guiding member 32 is mounted on the said furnace liner 1, the said furnace liner 1 is capable of moving up and down within the said storage cavity 23 via the guiding member 32 along the sliding groove. In another specific embodiment, the sliding groove member 31 may also be mounted on the said furnace liner 1, while the guiding member 32 is mounted inside the said base 2, the said furnace liner 1 is capable of moving up and down within the said storage cavity 23 via the guiding member 32 along the sliding groove.

Specifically, the said sliding assembly provides a stable movement track for the furnace liner through the sliding cooperation between the sliding groove member and the guiding member. When the wood-burning stove needs to be unfolded for combustion and heating, the operator pulls up the first annular wall member 11 of the furnace liner 1. At this time, the guiding member 32 installed on the first annular wall member 11 will slide upward along the sliding groove member 31 inside the base 2; as the guiding member 32 gradually moves up along the sliding groove on the sliding groove member 31, the furnace liner 1 as a whole rises synchronously, the liner seat 12 originally located in the said storage cavity 23 gradually protrudes from the said storage cavity 23, and the exposed volume of the combustion chamber 13 increases accordingly until the guiding member 32 slides to the top end of the sliding groove or a preset position, and the furnace liner 1 stops rising. At this time, the combustion chamber 13 is fully expanded, capable of accommodating fuel such as firewood and adapting to cooking containers of different heights. When the wood-burning stove needs to be stored to reduce the volume, the operator presses down on the first annular wall member 11 of the furnace liner 1, the guiding member 32 slides downward along the sliding groove member 31, the furnace liner 1 as a whole descends synchronously, and the liner seat 12 gradually re-enters the storage cavity 23 of the base 2, and the exposed part of the combustion chamber 13 gradually decreases; until the guiding member 32 slides to the bottom of the sliding groove, the liner seat 12 completely fits against the bottom plate 22. At this time, the furnace liner 1 and the base 2 form a compact nesting structure, and the overall height is significantly reduced, facilitating carrying in a backpack or storage box.

In the said embodiment, the said sliding groove member 31 is vertically mounted within the said storage cavity 23, the said guiding member is mounted on the said first annular wall member 11, and the said first annular wall member 11 is capable of moving up and down within the storage cavity 23 along the sliding groove of the said sliding groove member 31. Specifically, the sliding groove member can be vertically mounted to ensure that the furnace liner can only move along the vertical direction, avoiding offset or tilting during telescoping. The guiding member is fixed on the said first annular wall member 11, and when an external force acts on the first annular wall member, the guiding member slides smoothly along the vertical sliding groove, driving the entire furnace liner to move up and down synchronously.

In the said embodiment, the said first annular wall member 11 includes a first outer wall 111 and a first inner wall 112 constructed inside the first outer wall, the said bottom of the said first inner wall 112 is connected to the liner seat 12, the liner seat 12 and the first inner wall 112 collectively define the combustion chamber 13; a gas guiding space 113 is enclosed between the said first outer wall 111 and the first inner wall 112, an air inlet communicating with the said gas guiding space 113 is clamped and formed by the bottom of the first outer wall 111 and the bottom of the first inner wall 112; the upper part of the said second annular wall member 21 sleeves over the outer side of the said first outer wall 111.

In the said embodiment, the said first annular wall member 11 adopts a coaxial design for the outer layer and the inner layer, the said first outer wall 111 is an annular component, serving as the outer protective layer and the sleeving base of the furnace liner 1; the said first inner wall 112 is also an annular component, nested coaxially inside the said first outer wall 111, and a uniform gap is maintained between the two, which is the said gas guiding space 113. The bottom of the said first inner wall 112 is fixedly connected to the upper edge surface of the liner seat 12, and the connecting part is sealed to prevent flames or high-temperature gas from leaking through the gap during combustion; the liner seat 12 is a circular structure, its diameter matches the inner diameter of the said first inner wall 112, and is finally enclosed by the inner side wall of the first inner wall 112 and the upper surface of the liner seat 12 to form a closed combustion chamber 13. The fuel tray 14 can be stably placed inside the said combustion chamber 13, providing a centralized combustion area for fuel such as firewood and charcoal. The said gas guiding space 113 is an annular cavity between the said first outer wall 111 and the said first inner wall 112, and its upper and lower ends respectively have flow paths: the upper end cooperates with the heat concentrating ring member 15 at the top of the said first annular wall member 11 to form an airflow outlet; the lower end communicates with the outside through the air inlet, the air inlet is clamped and formed by the bottom edge of the said first outer wall 111 and the bottom edge of the said first inner wall 112. The height of the said first outer wall 111 is slightly higher than the said first inner wall 112.

When the bottoms of the two are connected to the liner seat 12, an annular air inlet is naturally formed between the outwardly extending annular edge at the bottom of the first outer wall 111 and the inner edge at the bottom of the first inner wall 112. The said air inlet provides a stable air source for the said gas guiding space 113. The sleeving cooperation between the second annular wall member and the first outer wall: the said second annular wall member 21 is the outer annular component of the base 2, and its inner diameter is slightly larger than the outer diameter of the said first outer wall 111, ensuring that the said first outer wall 111 can slide smoothly along the inner side wall of the said second annular wall member 21, while avoiding excessive clearance that could cause the furnace liner 1 to shake. The specific sleeving portion is the upper part of the said second annular wall member 21 and the outer side wall of the said first outer wall 111. Regardless of whether the wood-burning stove is in the unfolded or collapsed state, the said gas guiding space 113 and the air inlet maintain an open state. External air actively flows into the gas guiding space 113 from the annular air inlet under the action of thermal pressure difference; when the air flows upward along the gas guiding space 113, it is preheated by the high temperature of the said first outer wall 111 and the first inner wall 112, forming a hot airflow; finally, the hot airflow enters the combustion chamber 13 from the upper end of the said gas guiding space 113, directly acting on the burning fuel on the fuel tray 14, supplementing sufficient oxygen to the fuel.

In the said embodiment, the said sliding groove member 31 is a connecting plate, a sliding groove 311 is opened on the said connecting plate, one end of the said connecting plate is mounted on the said bottom plate 22, and the other end is connected to the said first annular wall member 11 via the guiding member 32; the said guiding member 32 is capable of sliding up and down on the said connecting plate along the said sliding groove 311.

Specifically, the said sliding groove member 31 is a connecting plate made of high-temperature resistant material, and a vertical long-strip sliding groove 311 is opened on the plate body; one end of the connecting plate is fixed or welded to the bottom plate 22 by bolts, and multiple sets of connecting plates can be uniformly distributed along the circumferential direction of the bottom plate, and the other end is not directly fixed, but is indirectly connected to the said first annular wall member 11 through the guiding member 32. The guiding member 32 is a structural component adapted to the sliding groove, one end of which is fixedly connected to the first annular wall member 11, and the other end is embedded in the sliding groove 311 and does not come out.

In the said embodiment, a fixed clasp 312 is opened inside the end of the said connecting plate away from the bottom plate, and a guiding channel 313 is opened on the side of the said fixed clasp 312, wherein the said fixed clasp 312 communicates with the end of the said sliding groove 311 away from the bottom plate through the said guiding channel 313; the said guiding member 32 is capable of entering the said fixed clasp 312 from the sliding groove 311 through the said guiding channel 313, or entering the sliding groove from the fixed clasp 312 through the guiding channel.

The said fixed clasp 312 is opened in the top end region of the connecting plate away from the bottom plate 22, and its shape is adapted to the cross-section of the said guiding member 32. For example, when the guiding member is cylindrical, the clasp is set as an arc-shaped groove, or when the guiding member is square, it is set as a rectangular groove, and the depth of the clasp is slightly greater than the length of the guiding member embedded in the sliding groove, to prevent easy disengagement. The edge of the clasp can be provided with a slight chamfer to facilitate the smooth engagement of the guiding member. The said guiding channel 313 is opened on the side of the said fixed clasp 312 along the width direction of the said connecting plate, and the width of the channel matches the diameter of the said guiding member 32, ensuring that the guiding member can pass smoothly without obvious shaking. One end of the channel communicates with the said fixed clasp 312, the other end communicates with the top end of the sliding groove 311 away from the bottom plate, and an arc transition structure is provided at the connection between the channel and the sliding groove.

When the said wood-burning stove needs to be unfolded and fixed in height, the operator pulls up the first annular wall member 11 of the said furnace liner 1, driving the guiding member 32 to move vertically upward along the sliding groove 311 until the guiding member slides to the top end of the sliding groove 311; at this time, the furnace liner 1 is slightly rotated in the horizontal direction, and the guiding member 32 will enter the guiding channel 313 from the top end of the sliding groove 311 under the action of rotational force, and move along the channel toward the fixed clasp 312; when the guiding member 32 completely enters the said fixed clasp 312, the rotation stops, the recessed groove structure of the clasp will limit the movement of the guiding member, and the furnace liner 1 is locked at the current unfolded height. Even if slight vibration is encountered during outdoor use, the furnace liner will not slide down, ensuring safety during the cooking process.

When the wood-burning stove needs to be collapsed, the operator slightly lifts the furnace liner and then rotates the furnace liner in the opposite direction (i.e., opposite to the rotation direction during locking), so that the guiding member 32 disengages from the said fixed clasp 312, moves in the reverse direction along the guiding channel 313, and returns to the top end of the sliding groove 311; pressing down on the first annular wall member 11, the guiding member 32 slides vertically down along the sliding groove 311, driving the furnace liner 1 to descend synchronously, and the liner seat 12 gradually retracts into the storage cavity 23 of the base 2 until the guiding member slides to the bottom of the sliding groove, completing the collapse and storage.

In the said embodiment, an upwardly protruding limiting portion 314 is constructed at the lower wall of the said guiding channel 313, the said lower part of the said fixed clasp 312 has a bearing surface 315 for bearing the said guiding member 32, and the said limiting portion is connected to the said bearing surface 315.

In the said embodiment, the said guiding member 32 is a guiding column installed on the side opposite to the said first inner wall 112 and the first outer wall 111 and protruding towards the direction of the said first outer wall 111; or the guiding member may also be a guiding column installed on the side opposite to the said first outer wall 111 and the first inner wall 112 and protruding towards the direction of the said first inner wall 112; when the said guiding column moves along the sliding groove 311 inside the said sliding groove member 31, the said sliding groove member 31 moves within the said gas guiding space 113.

Specifically, the guiding column can be fixed to the outer side wall of the said first inner wall 112, which is the side opposite to the first inner wall and the first outer wall, and protrudes towards the inner side wall direction of the said first outer wall 111. At the same time, it must be ensured that it can be embedded in the sliding groove 311 of the said sliding groove member 31, and also ensure that it does not contact the inner side wall of the said first outer wall 111. Alternatively, the guiding column is fixed to the inner side wall of the said first outer wall 111, which is the side opposite to the first outer wall and the first inner wall, and protrudes towards the outer side wall direction of the said first inner wall 112. The protruding length and clearance requirements are the same as above, ensuring that it is adapted to the sliding groove 311 and does not obstruct movement. The guiding columns in both ways are made of high-temperature resistant material, and the ends of the columns are treated with an arc transition, and are connected to the first annular wall member using welding or integral forming process to prevent loosening and falling off under high temperature.

In the said embodiment, the said first outer wall 111 has a first sealing ring 114 protruding outward constructed circumferentially at the bottom, and the said second annular wall member 21 has a second sealing ring 211 protruding inward constructed circumferentially at the top.

The said first outer wall 111 has a first sealing ring 114 protruding outward constructed circumferentially at the bottom, and the said second annular wall member 21 has a second sealing ring 211 protruding inward constructed circumferentially at the top. Both are made of high-temperature resistant material, and are fixed to the corresponding annular wall member through integral forming or welding to prevent falling off under high temperature, and can withstand the radiant heat of the combustion chamber 13 for a long time without deformation; the first sealing ring 114 is a circumferentially extending annular protrusion, forming a continuous outwardly protruding sealing surface; the second sealing ring 211 is a circumferentially extending annular protrusion, and the height of the protrusion is adapted to the said first sealing ring, forming a continuous inwardly protruding sealing surface.

In the said embodiment, the said base 2 further includes a plurality of leg members 24 connected to the said lower part of the said bottom plate, the said leg members 24 are capable of rotating inward and folding relative to the said bottom plate 22, and the upper part of the said first annular wall member 11 is connected to the upper part of the said first annular wall member 11 through a heat concentrating ring member 15 to close the said upper part of the said gas guiding space 113.

The said leg members 24 can be set to three or more groups, uniformly distributed circumferentially along the lower surface of the said bottom plate 22, and connected to the bottom plate 22 by hinges or axle pins. The said connecting parts are treated for rust prevention to adapt to outdoor humid environments. The length is designed so that when unfolded, it can lift the bottom plate 22 off the ground by 3-5 cm, which not only prevents heat loss due to direct contact between the bottom plate and the ground and contamination from ground water and debris, but also ensures the stable placement of the wood-burning stove. When unfolding for use, the leg members 24 are rotated outwards to form an angle of 90° to 120° with the bottom plate 22, supporting the base 2 by multiple points; when storing, the leg members 24 are rotated inwards to fit against the lower surface of the said bottom plate 22. In conjunction with the action of the furnace liner 1 retracting into the storage cavity 23, this allows the wood-burning stove to form a flat columnar structure, reducing the space occupied during carrying.

In the said embodiment, the said heat concentrating ring member 15 is an annular high-temperature resistant component, its inner diameter matches the outer diameter of the upper part of the said first annular wall member 11, and it is fixed to the upper part of the said first annular wall member 11 by welding or bolt fastening, covering the upper opening of the said gas guiding space 113. This ensures that after air enters from the air inlet, it can only flow upward along the said gas guiding space, flowing directionally into the said combustion chamber 13; it also concentrates heat to prevent loss, blocks the heat from the combustion chamber from spreading around, and reflects it back to the combustion chamber or directs it to the bottom of the cooking container, improving heat utilization efficiency, while avoiding direct abrasion of the said first annular wall member 11 by the bottom of the cooking container. Furthermore, the heat concentrating ring member moves up and down with the first annular wall member, and whether the wood-burning stove is unfolded or collapsed, it always maintains the sealing of the upper part of the gas guiding space, preventing damage to the airflow path.

Finally, it should be noted that the above embodiments are only used to illustrate the technical solution of the said utility model and not to limit it; although the said utility model has been described in detail with reference to the aforementioned embodiments, those skilled in the art should understand that: the technical solutions recorded in the foregoing embodiments can still be modified, or some of the technical features can be equivalently substituted; and these modifications or substitutions do not make the essence of the corresponding technical solution deviate from the scope of the technical solutions of the embodiments of the said utility model.

In summary, the above description is only a preferred embodiment of the said utility model, and all equivalent variations and modifications made in accordance with the scope of the patent application for the said utility model shall be covered by the said utility model patent.

The invention claimed is:

1. A retractable and foldable wood-burning stove, comprising:

a furnace liner, which includes a first annular wall member and a liner seat, wherein the liner seat is connected to a lower portion of the first annular wall member, wherein the liner seat and the first annular wall member collectively define a combustion chamber, and a fuel tray is disposed within the said combustion chamber;

a base, which includes a second annular wall member and a bottom plate connected to a lower part of the second annular wall member, wherein the bottom plate and the second annular wall member collectively define a storage cavity, and the second annular wall member surrounds the first annular wall member; and a telescoping structure connected to the base and the furnace liner, wherein the furnace liner is capable of moving relative to the base via the telescoping structure to change the position of the said liner seat within the said storage cavity.

2. The retractable and foldable wood-burning stove according to claim 1, wherein:

the telescoping structure comprises a plurality of sliding assemblies, wherein a sliding assembly includes a sliding groove member and a guiding member, and said guiding member is connected to said sliding groove member and is movably connected within the sliding groove of the corresponding said sliding groove member;

the sliding groove member is mounted inside the base, and said guiding member is mounted on the furnace liner, wherein the furnace liner is capable of moving up and down within the storage cavity via said guiding member along the sliding groove; or the sliding groove member is mounted on the furnace liner, and the guiding member is mounted inside the base, wherein the furnace liner is capable of moving up and down within the storage cavity via said guiding member along the sliding groove.

3. The retractable and foldable wood-burning stove according to claim 2, wherein:

the sliding groove member is vertically mounted within the storage cavity, and the guiding member is mounted on the first annular wall member, wherein the first annular wall member is movably connected up and down within the storage cavity along the sliding groove of said sliding groove member.

4. The retractable and foldable wood-burning stove according to claim 3, wherein:

the sliding groove member is a connecting plate, wherein a sliding groove is opened on said connecting plate, one end of said connecting plate is mounted on the bottom plate, and the other end is connected to the first annular wall member via the guiding member; the guiding member is capable of sliding up and down on said connecting plate along the sliding groove.

5. The retractable and foldable wood-burning stove according to claim 4, wherein:

a fixed clasp is opened inside the end of the connecting plate away from the bottom plate, and a guiding channel is opened on the side of said fixed clasp, wherein said fixed clasp communicates with the end of the sliding groove away from the bottom plate through the guiding channel; the guiding member is capable of entering said fixed clasp from the sliding groove through the guiding channel, or entering the sliding groove from said fixed clasp through the guiding channel.

6. The retractable and foldable wood-burning stove according to claim 5, wherein:

an upwardly protruding limiting portion is constructed at the lower wall of the guiding channel, and the lower part of the fixed clasp has a bearing surface for bearing the guiding member, wherein said limiting portion is connected to the bearing surface.

7. The retractable and foldable wood-burning stove according to claim 3, wherein:

the first annular wall member includes a first outer wall and a first inner wall constructed inside the first outer wall, wherein the bottom of the first inner wall is connected to the liner seat, and the liner seat and the first inner wall collectively define the combustion chamber;

a gas guiding space is enclosed between the first outer wall and the first inner wall, and an air inlet is defined between the bottom of the first outer wall and the bottom of the first inner wall, wherein the said air inlet communicates with said gas guiding space, and the upper part of the second annular wall member sleeves over the outer side of the first outer wall.

8. The retractable and foldable wood-burning stove according to claim 7, wherein:

the guiding member is a guiding column installed on the side opposite to the first inner wall and the first outer wall and protruding towards the direction of the first outer wall; or the guiding member is a guiding column installed on the side opposite to the first outer wall and the first inner wall and protruding towards the direction of the first inner wall;

when the guiding column moves along the sliding groove inside the sliding groove member, the sliding groove member moves within the said gas guiding space.

9. The retractable and foldable wood-burning stove according to claim 8, wherein:

a first sealing ring protruding outward is constructed circumferentially at the bottom of the first outer wall, and a second sealing ring protruding inward is constructed circumferentially at the top of the second annular wall member.

10. The retractable and foldable wood-burning stove according to claim 9, wherein:

the base further includes a plurality of leg members connected to the lower part of the bottom plate, wherein said leg members are capable of rotating inward and folding relative to the bottom plate; a heat concentrating ring member is connected to the upper part of the first annular wall member to close the upper part of the said gas guiding space.

* * * * *